United States Patent [19]

Kasuba et al.

[11] 4,354,634

[45] Oct. 19, 1982

[54] RAIL OVERTURN PREVENTION DEVICE

[75] Inventors: John A. Kasuba, Germantown, Tenn.; Graham M. Fee, Geneva; Phillip M. Hoskins, Conneaut, both of Ohio

[73] Assignee: True Temper Railway Appliances, Inc., Chicago, Ill.

[21] Appl. No.: 152,133

[22] Filed: May 21, 1980

Related U.S. Application Data

[63] Continuation-in-part of Ser. No. 888,245, Mar. 20, 1978, abandoned.

[51] Int. Cl.[3] ..... E01B 9/46

[52] U.S. Cl. ..... 238/338; 238/374

[58] Field of Search ..... 238/287, 294, 304, 310, 238/338, 343, 351, 366, 374

[56] References Cited

U.S. PATENT DOCUMENTS

| | | | |
|---|---|---|---|
| 858,983 | 7/1907 | Hinchman | 238/374 X |
| 894,253 | 7/1908 | Bowditch | 238/374 X |
| 937,054 | 10/1909 | Davidson | 238/374 X |
| 983,690 | 2/1911 | Croft | 238/374 X |
| 1,028,674 | 6/1912 | Caron | 238/374 X |
| 1,324,614 | 12/1919 | Nyman | 238/294 |
| 1,390,203 | 9/1921 | Gonzalez | 238/374 X |
| 1,414,784 | 5/1922 | McVicker | 238/304 |
| 1,531,927 | 3/1925 | Hamilton | 238/304 |
| 2,096,775 | 10/1937 | Woodings | 238/351 |
| 2,167,864 | 8/1939 | Bailey | 238/351 |

FOREIGN PATENT DOCUMENTS

| | | | |
|---|---|---|---|
| 668649 | 12/1938 | Fed. Rep. of Germany | 238/338 |

*Primary Examiner*—Randolph A. Reese

*Attorney, Agent, or Firm*—Squire, Sanders & Dempsey

[57] ABSTRACT

A device for deterring the overturning of railroad rails comprised of a generally C-shaped boltless clip for restraining the upward movement of a rail base flange. The clip is disposed within an existing spike hole in a conventional railroad tie plate with its upper arm positioned in partially overlapping, spaced relation to the rail base flange and its lower arm, which is formed into a catch, in anchored engagement beneath the tie plate and wedged into the tie supporting the rail. In the presence of rail overturn forces, the clip couples the rail base flange to the tie plate.

4 Claims, 4 Drawing Figures

RAIL OVERTURN PREVENTION DEVICE

CROSS REFERENCE TO RELATED APPLICATION

This application is a continuation-in-part of Ser. No. 888,245, filed Mar. 20, 1978, now abandoned.

FIELD OF INVENTION

This invention relates to means for deterring the overturning of railroad rails.

BACKGROUND OF THE INVENTION

With the advent of mechanical motive power in railways in the first half of the nineteenth century, the building of railroads capable of withstanding the forces produced both by the weight and speed of railway vehicles has been a fertile source of problems and engineering solutions. The basic method of building a railroad has changed little. The roadbed is smoothed and tamped and cross ties, usually relatively heavy hardwood timbers, are placed at generally uniform intervals transverse to the direction of the rails on and slightly sunken into the roadbed. A pair of tie plates each having recesses adapted to accept and limit the side-to-side motion of the base flanges of rails are placed on each tie. The rails are set in the tie plate recesses with the gauge sides opposing each other, i.e. to the inside of the track, leaving the field sides to the outside of the track. Fasteners, such as spikes, are driven into the ties through prepared holes in the tie plates so that portions of some part of the fasteners, such as portions of spike heads, overlap the rail flanges and clamp the rails and plates to the respective ties. The roadbed around and below the top surfaces of the ties is generally covered with a ballast, such as crushed stone, to anchor the ties and to prolong roadbed life.

Passing railway vehicles transmit both vertically downward and transverse forces to the rails. The transverse forces produce bending moments which tend to turn rails over with potentially disasterous consequences. Large transverse forces are transmitted to rails in roadbed curves by vehicle wheel flanges, particularly to the outside rail when the vehicles are traveling at high speed and to the inside rail on banked curves when the vehicles are moving slowly. Large rail overturning forces are also produced when a vehicle truck, on which the vehicle wheels are mounted, becomes stuck and fails to rotate to allow the wheels to follow rail curvature. In that situation, wheels "plow" into the rails producing rail overturning moments. In other circumstances, the separation of the rails may be somewhat greater than a vehicle's wheelbase causing the trucks to "hunt" or drift from side to side within the rails so that the wheels again plow into the rails.

Numerous devices have been disclosed over the relatively long history of railroading to combat the effects of the rail overturn phenomenon. Most of these devices are directed to limiting longitudinal rail creep, but all inherently have some rail overturn resistance properties. The devices typically involve a two-piece fastener generally having a C-shaped gripping knuckle or clip of some sort, a specially adapted tie plate and a spike for wedging the clip into firm contact with the rail, or, in the case of ties made of an artificial material such as concrete, a specially formed tie socket into which the clip is wedged. Without the use of a clip, a transverse force applied by a wheel flange to the upper part of the inside or gauge surface of a rail causes the rail to attempt to rotate about an axis along the field side bottom edge of the rail flange. In the overturn rotation or attempted rotation, the gauge side base flange lifts up and the edge of the flange describes an overturn path. A clip clamping, in the overturn path, the rail flange and tie plate together shifts that axis of rotation to the field side bottom edge of the tie plate, provided the clip does not break or lose its gripping power, such as from fatigue. The shifting of the axis of rotation improves rail overturn resistance because it increases the length of the lever arm which, with the vertical downward force caused by the passing vehicle, produces a countermoment resisting overturn.

Previously disclosed clips intended for use with conventional wooden ties fall into two categories: those in which the wedged clip lies entirely above the upper surface of the tie; and those in which the clip lies in part below the upper surface of the tie. Both types of clips generally span and clamp the combined thickness of the tie plate and the rail flange. Examples of the former constructions, which avoid any notching or cutting of the ties, are found in U.S. Pat. No. 1,213,338 (Crowley), U.S. Pat. No. 1,414,784, U.S. Pat. Nos. 1,474,787, 1,551,502 (all to McVicker), U.S. Pat. No. 2,160,344 (Ryan) and U.S. Pat. No. 2,167,864 (Bailey). Each of these devices requires the use of a tie plate specially adapted on its underside to accept the clip's lower arm that is situated between the bottom of the tie plate and the upper surface of the tie. With the exception of the Bailey patent, the cited patents provide that the upper arm of the clip firmly grips the upper surface of the rail flange. The Bailey clip provides a space between the upper arm of the clip and the upper surface of the rail flange to accomodate thermal expansion. All the cited patents except those to Ryan and Bailey, provide that the stem joining the upper and lower arms of the clips bears directly on a side surface of the rail flange. Because of the constant contact of the rail flanges and clips in these constructions, the clips appear to be particularly susceptible to fatigue. Whether the overturn resistance is improved or not by these devices depends upon the effectiveness (i.e., condition) of the clip.

U.S. Pat. No. 1,531,927 (Hamilton) and German Patentschrift No. 668,649 (Rudert) disclose clips which in part extend below the upper surface of the associated wooden ties. In these constructions sockets must be specially prepared in the ties to receive the portion of the clip and related elements projecting beneath the upper surface of the tie. Specially adapted tie plates are needed to utilize both of these devices. The Hamilton clip grips the upper surface of the rail flange and the underside of the tie plate, but does not engage the underlying tie. That clip is far more difficult to use than are the other devices discussed herein, since the clip must be inserted into the rail—tie plate—tie assembly and driven into final position before the adjacent spike may be driven. The patent to Rudert, directed toward compensating for the sinking of the entire rail assembly into a softwood tie, comprises metal receptacles fitting into tie sockets and a spike protruding into each receptacle. Since in this construction the spikes (and the clips) do not engage the ties, a wedging clip gripping the underside of the tie plate within the socket and the top surface of the rail flange is provided. Reconstruction of existing railroads with either the Hamilton or Rudert constructions is particularly difficult and expensive because existing ties must have precise sockets cut in them or be removed and replaced by socketed ties.

Numerous others have proposed wedged clips for use with ties constructed of artificial materials such as asphalt and sand, concrete and metal. Examples include U.S. Pat. Nos. 858,983, 894,253, 937,054, 983,690, 1,028,674, 1,034,614, 1,242,184, and 1,390,203, wherein tie sockets adapted to accept a clip held in position by an adjacent wedge are provided. These clips have lower arms adapted to hook over a shoulder within the socket or on the bottom surface of the tie, and upper arms adapted to grip the rail base flange. All of these devices require specially adapted tie plates and ties so that these devices cannot be used in reconstruction of existing railroads unless existing ties not previously adapted to the clips are removed and replaced. None of these constructions are economically susceptible for use with wooden ties, even in new railway construction, because of the difficulty of cutting the appropriate sockets into wooden ties.

SUMMARY OF THE INVENTION

It is an object of the present invention to provide improved rail overturn deterrence by means of a device for use with conventional ties and tie plates.

Another object of the invention is to provide improved rail overturn deterrence by the use of a boltless clip passing through an existing spike hole in a conventional tie plate in anchored engagement with the underlying tie.

Yet another object of the invention is to minimize the transmission of metal fatigue inducing forces to a rail overturn prevention clip.

A general object of the invention is to provide an improved rail overturn prevention device which may be economically used in railroad construction or reconstruction which is efficient and effective in use and which can be manufactured in an economical and practical manner.

The objects of the invention are accomplished according to the preferred embodiment by providing a generally C-shaped clip having angled upper and lower arms joined by a stem longer than the combined thickness of the rail flange and tie plate. The clip is adapted to be disposed in a conventional tie plate with the upper arm in a spaced relation to and in the overturn path of the upper surface of the base flange of a rail and the stem in a spaced relation to the side surface of the flange. The spaced relationships minimize transmission of fatigue-inducing forces to the clip and isolate the clip from rail restraining action except when a possibility of overturn exists. This configuration provides long clip life reliably achieving the desired improvement in the rail overturn deterring by coupling, in the presence of overturn forces, the rail base flange to the tie plate. The lower arm of the clip has a relatively sharp edge which is wedged into engagement with the tie beneath the tie plate by use of an associated specially adapted spike.

Other objects and advantages of the invention will appear to those skilled in the art from the following description of the invention and a preferred embodiment of it, and the accompanying drawings.

DETAILED DESCRIPTION OF PREFERRED EMBODIMENT

Figure 1:
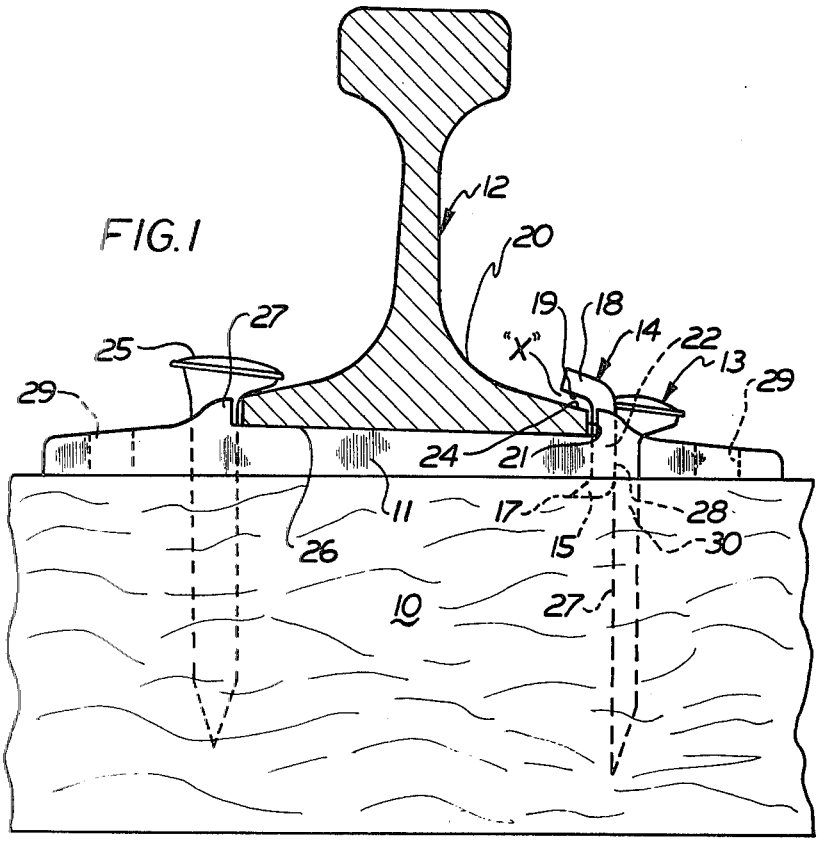
FIG. 1 is a transverse sectional view through a rail, a tie plate, a clip according to the invention and a spike, showing a portion of the tie underlying the rail.
Figure 2:
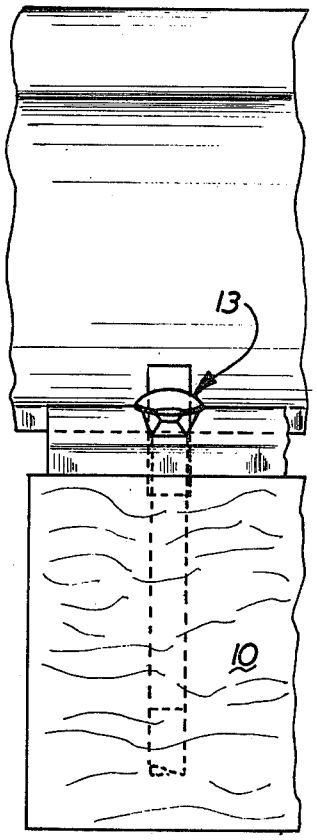
FIG. 2 is a side view of the assembly shown in FIG. 1.
Figure 3:
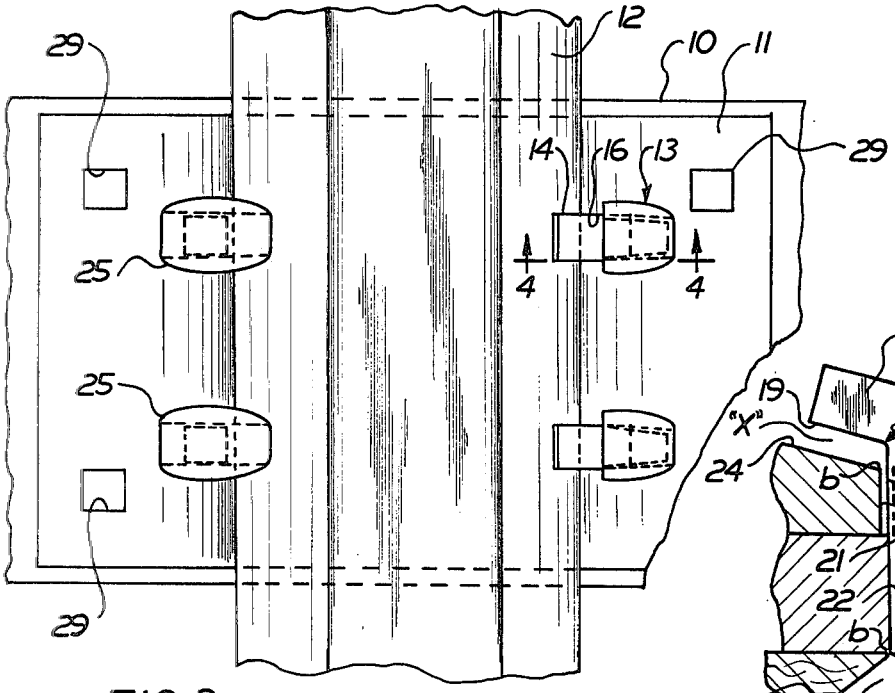
FIG. 3 is a plan view of the assembly shown in FIG. 1.

The preferred embodiment of the invention is shown in detail in the attached drawings. In the drawings all like parts are designated by like reference numerals. Turning to FIGS. 1, 2 and 3, there is shown a portion of a tie 10 supporting a conventional tie plate 11 on which is seated a rail 12. A specially adapted spike means such as a spike 13 in conjunction with a clip 14 secures the gauge side of rail 12 to tie 10. Tie 10 is a conventional tie of a resilient material, such as wood, into which spikes may be driven. Tie plate 11 is a conventional tie plate having openings 16 therethrough for receiving spikes. Typically, a tie plate has four openings 16 for use with a particular size rail and may in addition have a second set of openings 29 not used in the present invention. Tie plate 11 has a recess 26 bounded by shoulders 27 adapted to receive and limit the side-to-side motion of rail 12. Conventional railroad rail 12, having a base flange 20 and, on the gauge side, a flange side surface 21 and an upper flange surface 24, is seated in recess 26 of tie plate 11. Specially adapted spike 13 has a shank 30 with surface 27 opposed to the gauge side of rail 12 and bearing over part of its length on clip 14. Clip 14 includes a first or lower arm 15 terminating in a catch means, such as edge 17, in engagement with tie 10, a second or upper arm 18 having an undersurface 19 and a stem 22, of a length exceeding the combined thicknesses of the adjacent tie plate 11 and base flange 24, interconnecting arms 15 and 18 so that the arms and stem generally form the shape of the letter C. The stem has an inside surface 23 inside the "C" opposing flange side surface 21 and an outside surface 28 opposing inside surface 23. Outside surface 28 bears on a portion of surface 27 of spike shank 30. A conventional spike 25 is used on the field side of rail 12 to fasten it through the intermediacy of tie plate 11 to tie 10. In FIG. 3, the preferred application of the invention is depicted in plan view. Two clips 14 and associated specially adapted spikes 13 are installed on the gauge side of rail 12 through openings 16 in tie plate 11 and two conventional spikes 25 are installed on the field side of rail 12 through openings 16 in tie plate 11.

When the preferred embodiment of the rail overturn prevention device is installed, lower arm 15 of clip 14 is opposed to the gauge side of rail 12 and lies partially within tie 10. Edge 17 engages tie 10. Stem 22 of clip 14 is generally vertical and, along with shank 30 of spike 13, passes through an opening 16 in tie plate 11, a portion of the generally planar surface 27 of shank 30 bearing against generally planar outside surface 28 of stem 22. Upper arm 18, which is also opposed to the gauge side of rail 12, has its undersurface 19 in the overturn path of upper base flange surface 24 and spaced from and generally parallel to upper flange surface 24. Inside surface 23 of stem 22 is spaced from and generally parallel to flange side surface 21.

Figure 4:
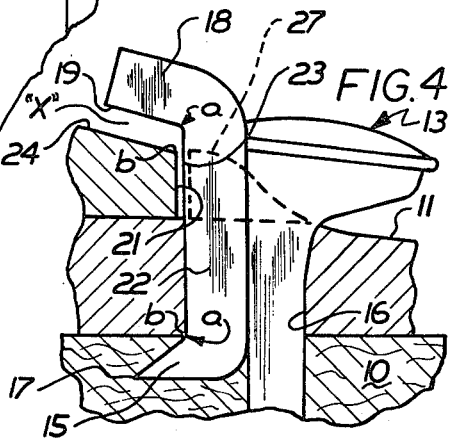
FIG. 4 is an enlarged detailed sectional view taken substantially along line 4—4 of FIG. 3.

FIG. 4 shows in detailed cross section the arrangement of tie 10, tie plate 11, spike 13, clip 14 and rail flange 20. FIG. 4 further shows that the inside length of stem 22 of clip 14, the distance from "a" to "a", exceeds the sum of the combined thicknesses of the adjacent section of tie plate 11 and flange 20 so that a gap or breathing space labelled "x" is provided between undersurface 19 of upper arm 18 and the upper flange surface 24. The length of stem 22 (and, consequently, the width of the gap "x") is chosen so that mild rail overturn forces do not raise base flange surface 24 enough for it to contact clip surface 19. Strong rail overturn forces do cause the gap to close, however, so that the clip restrains the flange from further motion along its overturn path. Also shown in FIG. 4 is the separation between flange side surface 21 and inside surface 23 of stem 22.

Installation of the clips is preferrably limited to those portions of track where rail overturn is most probable, such as on the outside track along curves. Preferrably the clips and associated spike means are installed in pairs in each tie plate, so that both normally used spike openings in a tie plate on the gauge side of a rail contain clips. While clips may be installed one to a tie plate, we have found better overturn resistance is obtained by paired use.

The clip and associated spike means may be installed in a solid tie or one with a pre-existing pilot or spike hole. Where clips are to replace conventional spikes in reconstructing track, the hole left by the removed spike is plugged with a wooden shaft of appropriate cross section, cut off flush with the top surface of the rail. In either case, a clip according to the preferred embodiment is installed by leaning its upper arm 18 on rail flange surface 24 so that lower arm 15 and its edge 17 rest on tie 10 along the edge of opening 16 in tie plate 11. Spike 13 is then inserted in opening 16 adjacent to clip 14 and driven into tie 10 by conventional means. As spike 13 is driven into the tie it drives lower arm 15 and edge 17 down and into tie 10 by a cam-like action. The catch means is preferrably a beveled, relatively sharp, chisel-like wedge uniform across the width of the clip, such as edge 17. That configuration allows economical manufacture of the clip; but other configurations, such as a corrugated sharpened edge might be employed for the catch means. The edge configuration is limited only by the requirement that it wedge into engagement with the tie.

Clip 14 and spike 13 have widths approximately equal to, but not exceeding, that of the shank of the spike normally employed with the tie plate being used. The sum of the thicknesses of stem 22 of clip 14 and of shank 30 of spike 13 is chosen to be approximately equal, but not in excess of, the thickness of the shank of the spike normally employed with the tie plate being used. We prefer that the spike means be either a conventional spike sawn longitudinally to the desired thickness, such as spike 13, or a specially prepared spike having an appropriate shank cross section and offset head that will not interfere with the driving or functioning of clip 14. In either case, the clip and associated spike means may be installed in new railroad construction or existing railroad reconstruction without the necessity of carrying a variety of special tie plates and other parts since the clips and spike means fit in the conventional tie plate holes. The only special parts required are the clips and associated spike means.

In operation, the clip normally performs no active function. It is relatively isolated from the forces of passing vehicles by the cushioning effect of the resilient tie. The forces that are transmitted to the clip from the rail are coupled through the tie plate and spike means. Because of the relatively large contact area between the clip and spike means, the forces are not concentrated at any part of the clip. Therefore, the clip is particularly resistant to fatiguing forces which might otherwise cause premature weakening and failure.

Mild rail overturn forces cause the gauge side rail flange to rise less than the width of the gap between the undersurface of the upper arm of the clip and upper flange surface so that those parts do not contact. Stronger overturn forces cause the upper arm of the clip to restrain the motion of the flange along the overturn path so that the clip together with the tie plate act to restrain rail overturn. Because the clip is only called into action to restrain relatively strong overturning forces, it is not weakened or fatigued by repeated smaller restraining actions as are clips which constantly contact the rail flange. By isolating the clip from fatiguing and relatively small restraining forces, the invention provides an extended effective clip lifetime during which the improvement in rail overturn deterrence is achieved.

Through the invention and preferred embodiment described, a rail overturn restraining clip and spike means can be used with conventional railroad components, to provide improved rail overturn deterrence while extending clip life by minimizing fatigue, in an economical and efficient manner.

The specific embodiment shown and described is but one means of accomplishing the invention described and it should be understood that those skilled in the art may devise various omissions, substitutions and modifications without departing from the spirit of the invention. Accordingly, it is intended that the scope of the present invention be limited solely by the following claims.

What is claimed is:

1. A railway rail overturn prevention device for use as part of a railroad having a cross tie supporting a tie plate, said tie plate having at least one hole therethrough, and a rail having a base flange seated on the tie plate adjacent to the hole, the flange having an overturn path when the rail rotates about its length due to forces created by passing railway vehicles, the flange and tie plate defining a combined thickness, said device comprising a generally C-shaped clip having:

a first arm terminating in a catch means, said catch means being beveled to form a wedge for penetrating the tie and for engaging the tie at a distance below the tie plate when said device is installed in the tie plate;

a second arm spaced from and opposite to said first arm; and a stem joining said first and second arms, said stem having a length spacing said arms by a distance exceeding said combined thickness and locating said second arm in the overturn path of the flange and said second arm being disposed in partially overlapping, spaced relation to said flange defining a gap therebetween when the device is installed, said gap being of a size sufficient to isolate said clip from the rail except when strong rail overturn forces occur and said gap closing in response to the occurrence of strong rail overturn forces;

wherein said second arm comprises stop means for restraining motion of said flange beyond the limit of said gap when said device is installed.

2. A two-piece railway rail overturn prevention device for use as part of a railroad having a cross tie supporting a tie plate, said tie plate having at least one spike-receiving hole therethrough, and a rail having a base flange seated on the tie plate adjacent to the hole, the flange having an overturn path when the rail rotates about its length due to forces created by passing railway vehicles, the flange and tie plate defining a combined thickness, said device comprising:

a generally C-shaped metal clip having:

a first arm terminating in a catch means, said catch means being beveled to form a wedge for penetrating the tie and for engaging the tie at a distance below the tie plate when said device is installed in the tie plate;

a second arm spaced from said first arm; and a stem joining said first and second arms and spacing them by a distance exceeding said combined thickness and locating said second arm in the overturn path of the flange and said second arm is partially overlapping, spaced relation to said flange defining a gap therebetween, said gap being of a size to isolate said clip from the rail except when strong rail overturn forces occur and when gap closing in response to the occurrence of strong rail overturn forces, and said stem being dimensioned for disposition within the spike-receiving hole in said tie plate;

wherein said second arm comprises stop means for restraining motion of said flange beyond the limit of said gap when said device is installed; and spike means adapted to be driven through a spike-receiving hole for forcing said catch means into engagement with said tie at a distance below the tie plate for retaining said clip within the tie and tie plate.

3. The combination of a railroad cross tie, a tie plate supported by the tie and having at least one spike-receiving hole therethrough, a railway rail having a base flange seated on the tie plate adjacent to the hole, the flange having an overturn path when the rail rotates about its length due to forces created by passing railway vehicles, the flange and the tie plate defining a combined thickness, and a rail overturn prevention device comprising: a generally C-shaped clip having a generally vertical stem of a length exceeding said combined thickness, said stem being disposed within a spike-receiving hole in the tie plate, said stem terminating at its upper end in an upper arm disposed in partially overlapping, spaced relation above said flange and in the overturn path, the spaced relationship defining a gap between said flange and upper arm, said gap being of a size sufficient to isolate said clip from the rail except when strong rail overturn forces occur and said gap closing in response to the occurrence of strong rail overturn forces, said upper arm comprising stop means restraining further motion of said flange after the flange has moved so as to close the gap, said stem terminating at its lower end in a lower arm, said lower arm having an edge penetrating and engaging said tie at a distance beneath said tie plate; and spike means driven into said tie through the hole within which said clip is disposed and retaining said clip within said tie plate.

4. The invention according to claims 1, 2 or 3 wherein said stem joins said first and second arms at junctures, the juncture of said first arm and said stem engaging the tie plate to block said clip against withdrawal from the tie plate.

* * * * *